US007465187B1

(12) United States Patent
Wu

(10) Patent No.: US 7,465,187 B1
(45) Date of Patent: Dec. 16, 2008

(54) SWITCHABLE CABLE DEVICE

(75) Inventor: Hung-June Wu, Pan-chiao (TW)

(73) Assignee: June-On Co., Ltd., Taipei Hsien (TW)

( * ) Notice: Subject to any disclaimer, the term of this patent is extended or adjusted under 35 U.S.C. 154(b) by 0 days.

(21) Appl. No.: 11/834,666

(22) Filed: Aug. 6, 2007

(51) Int. Cl.
*H01R 11/00* (2006.01)

(52) U.S. Cl. ..... 439/502
(58) Field of Classification Search ..... 439/502
See application file for complete search history.

(56) References Cited

U.S. PATENT DOCUMENTS 6,672,896 B1 * 1/2004 Li ..... 439/502

* cited by examiner

*Primary Examiner*—Truc T Nguyen

(57) ABSTRACT

A switchable cable device suitable for connecting between an electronic device and an external peripheral device for signal transmission is disclosed. The switchable cable device comprises a cable having a connection at a side for electrically connecting to the electronic device and at least two branches disposed on another side thereof. Each branch has a connector and at least one extensional connector. The extensional connectors and connectors have circuit boards and chips which can independently renew an activation program.

6 Claims, 4 Drawing Sheets

SWITCHABLE CABLE DEVICE

BACKGROUND OF THE INVENTION

1. Field of the Invention

The present invention relates to a switchable cable device, more particularly, the present invention is related to a switchable cable device for electrically connecting between an electronic device and an external peripheral device for transmitting signal, and comprises a plurality of connectors and extensional connectors so that the switchable cable can switch to different external peripheral devices directly.

2. Description of Related Art

Along with the rapidly advancing technology, new electronic devices have been invented to bring provide greater convenience to the users at home, work or entertainment. Many electronic devices can be connected to the host through cables for transmitting signal, retrieving/reading or storing information. However, different electronic devices are designed differently by different manufacturers, and also the operation modes and the signal transmission methods are also different as well. Besides, the connector connected to the cable for signal transmission can be various as well. Example of the connectors include VGA connectors, the USB connectors, PS/2 connectors, IEEE 1394 connectors, RS232 connectors, RJ connectors, audio/video signal connectors, power connector, and the like. For the different connectors, the users need to have a multi-cables switch for switching to various devices connected thereto. The multi-cables switch comprises various types of connectors for connecting to the connector of the external peripheral devices with the cable, and a microprocessor to activate the connector to enable the electronic device to transmit signals to the host through the multi-cables connector to allow the switch to select the connector signal. Such conventional art has several defects described as follows.

1. The switch comprises the microprocessor and the cable inside the host case, and only suits for the compatible connectors. Therefore, the switch cannot be expanded. Besides, a plurality of cables has to be used while transmitting signals, and this causes inconvenience to the users, and expensive.

2. Each cable switch has a main body for positioning the microprocessor and the cable, and therefore the size of the cable switch is large and cannot be conveniently put away or portable. And the cables can easily get messed up.

Therefore, how to overcome the defect of the conventional design is an important issue for the manufacturer in the field.

SUMMARY OF THE INVENTION

Accordingly, the present invention provides a switchable cable device.

According to an embodiment of the present invention, the switchable cable device comprises a cable having a connector on a side thereof and at least two branches extending on another side thereof. Each branch comprises a connector and a plurality of extensional connectors. The connectors and the extensional connectors comprise a miniature circuit board and a chip for renewing and activating an operation program independently. Besides, the connectors and the extensional connectors are electrically connected to a plurality of electronic devices and a plurality of external peripheral devices. Through the connectors, the extensional connectors and the chips for transmitting signals, the switchable cable device of the present invention is easy to assemble or disassemble, and store and is portable.

According to another embodiment of the present invention, the switchable cable device comprises at least two branches extending to another side such that the switchable cable device may be in a Y shape (or a claw shape when the switchable cable device comprises more than two branches), and the extensional connectors of the branches connect to external connector of various types of external peripheral device.

DETAIL DESCRIPTION OF THE INVENTION

Figure 1:
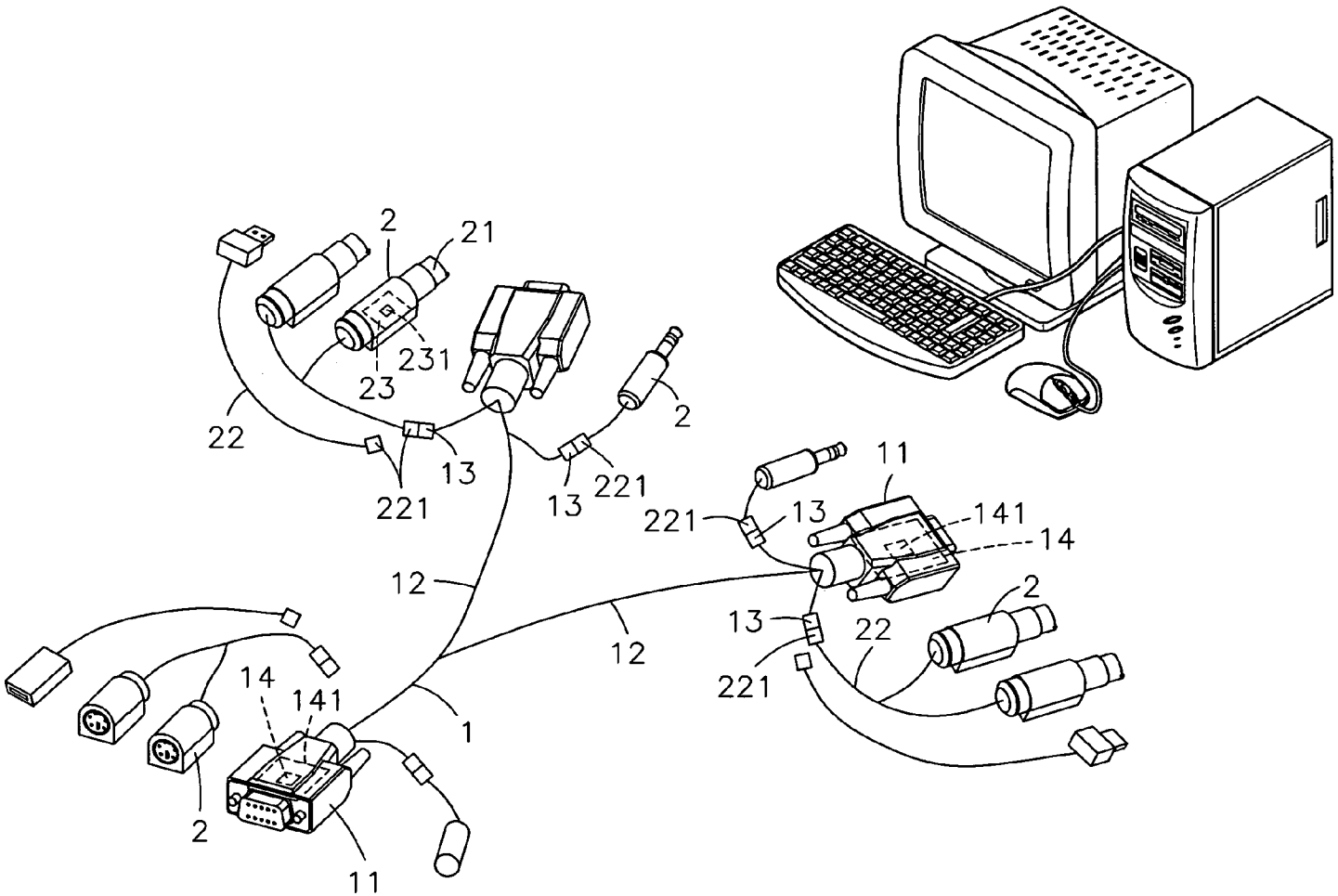
FIG. 1 is an elevational view of a switchable cable device according to an embodiment of the present invention.
Figure 2:
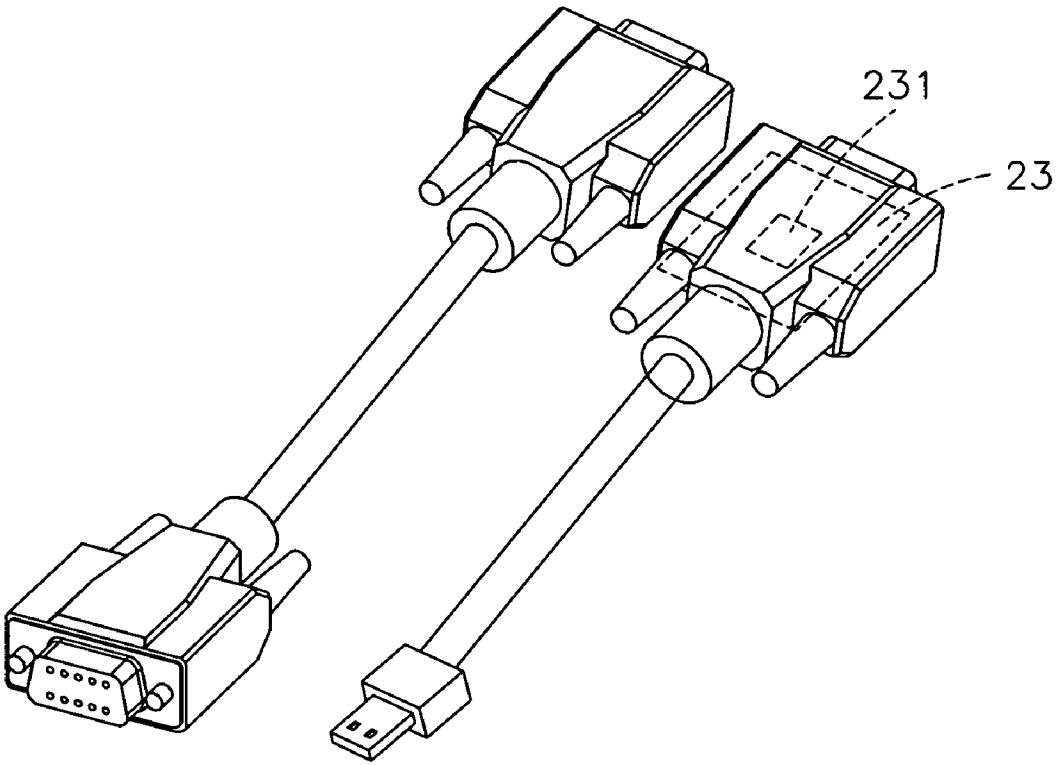
FIG. 2 is an elevational view of the switchable cable device according to a preferred embodiment of the present invention.
Figure 3:
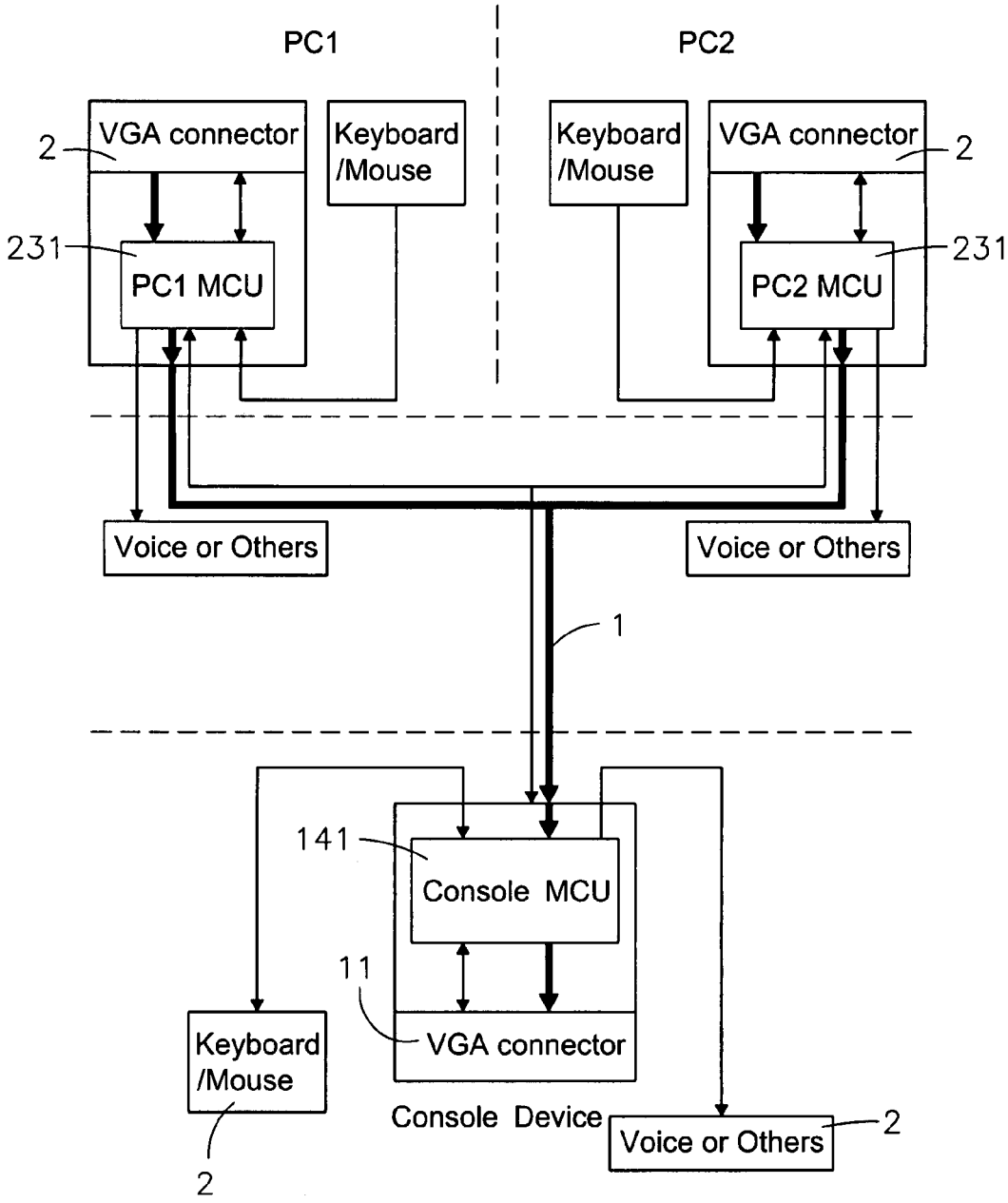
FIG. 3 is a block diagram of the switchable cable device according to an embodiment of the present invention.
Figure 4:
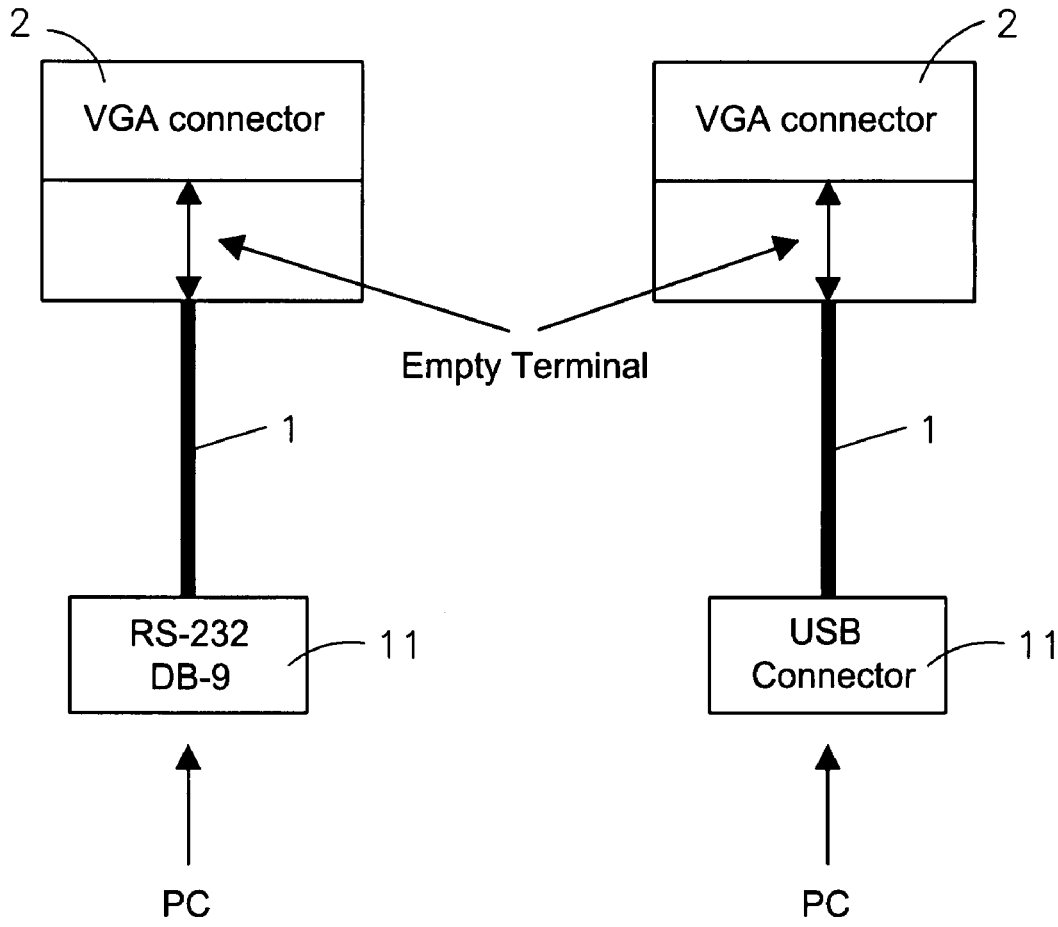
FIG. 4 is a block diagram of the switchable cable device according to a preferred embodiment of the present invention.

Referring to FIGS. 1 and 2, a switchable cable device of the present invention is shown comprised of a cable 1 and a plurality of external connectors 2.

The cable 1 comprises at least two branches 12 extending on a side thereof, and a plurality of connector 11 each is mounted on a distal end of the cable 1 and the branches 12. Thus, the cable 1 with the branches 12 is in a Y shape or a claw shape. The cable 1 and the branches 12 further comprise at least one extensional connector 13. A miniature circuit board 14 and a chip 141 are mounted in each connector 11 and each extensional connector 13 for controlling renewing or activating programs.

The external connector 2 comprises an adaptor portion 21 at a side thereof and an adaptor connector 221 on another side thereof connected to an external cable 22. A miniature circuit board 23 and a chip 231 are mounted in the external connector 2 and the adaptor connector 221 for controlling renewing or activating programs.

When in use, the cable 1 is used to connect the connector 11 to an PC port of an electronic device, and the adaptor connectors 221 of the external cables 22 of the external connectors 2 are electrically connected to the extensional connectors 13 of the cable 1 and the branches 12 so that the external connector 2 can be electrically connected to other external peripheral devices. The external connector 2 is selected according to the connector specification of the external peripheral device. At the same time, the miniature circuit board 14 and the chip 141 in the connector 11 and the extension connector 13 and the miniature circuit board 23 and the chip 231 in the external connector 2 and the adaptor portion 221 are used for processing interface information. Thus, the electronic device and the external peripheral device may be quickly connected without switching.

The above connector 11, the extensional connector 13, the external connector 2 and the adaptor connector 221 can be USB connectors, IEEE 1394 connectors, VGA connectors, RS232 connectors, RJ connectors, PS/2 connectors, audio/video signal connectors or power connectors for transmitting various signals. The miniature circuit board 14 and the chip 141 in the connector 11 and the extensional connector 13 and the miniature circuit board 23 and the chip 231 in the external connector 2 and the adaptor connector 221 can communicate each other by simple string signals, for example, I2C, SPI or UART. Therefore, the multi-chip structure is simplified, and the miniature circuit board 14 and the chip 141 (or the miniature circuit board 23 and the chip 231) can process information independently. Thus, the miniature circuit board 14 and the chip 141 (or the miniature circuit board 23 and the chip 231) can be pressed to attach to the connector 11, the extensional connector 13, the external connector 2 and the adaptor connector 221, and there is no need to connect to a host case with an external processing chip.

Because the miniature circuit board 14 and the chip 141 (or the miniature circuit board 23 and the chip 231) can communicate with each other by simple string signals, so the number of internal conducting wires in the cable 1 may be reduced. Besides, empty terminals of the connector 11 (or the extensional connector 13, the external connector 2 and the adaptor connector 221) may be used as a connecting interface of the miniature circuit board 14 and the chip 141 (the miniature circuit board 23 and the chip 231) for renewing programs and download programs from the electronic device (or computer) through an adaptor to write into the chip 141 (or the chip 231). Thus, the connector 11 (or the extensional connector 13, the external connector 2 and the adaptor connector 221) has the best compatibility with the electronic device or the external peripheral device without switching by other controlling chips, or activating by other activating programs.

Referring to FIGS. 1, 2, 3 and 4, a keyboard and a mouse in a PC port and a console of the general electronic device (for example computer) may be connected to the suitable external connectors 2 enable the keyboard and the mouse to electrically connect to the electronic device through the chip 231 in the external connector 2, and the programs in the chip 231 can judge and use the string signals to communicate. Meanwhile, according to the console user's command, internal circuit board signals of the PC port in the electronic device is connected to the miniature circuit board 23 and the chip 231 in the external connector 2 for switching. Besides, the external connector 2 and the branches 12 of the keyboard and the mouse may be fixed or removable type, and may be PS/2, USB, audio or serial-RS-232 enable the external connector 2 of the console suitable to connect to a variety of external peripheral devices.

The miniature circuit board 14 and the chip 141 of the connector 11 and extensional connector 13 and the miniature circuit board 23 and the chip 231 of the external connector 2 and the adaptor connector 221 can download to renew the programs according to the actual operation status or the specific operating system version of the connected electronic device or the external peripheral device. Thus, the connector 11, the extensional connector 13, the external connector 2 and the adaptor connector 221 may be upgraded. Besides, it is easy to store and carry, as there is no external housing or case on the cable 1.

The above description is merely used for demonstrating the embodiment of the present invention; any alteration or modification thereof shall be construed to be within the scope of the present invention. Through the connector 11, the extensional connector 13, the external connector 2 and the adaptor connector 221, the cable 1 of the present invention can be electrically connected to the electronic device and the external peripheral device. Beside, the string signals for communication between the miniature circuit board 14 and the chip 141 of the connector 11 and the extensional connector 13 and the miniature circuit board 23 and the chip 231 of the external connector 2 and the adaptor connector 221 are used to download the suitable programs enable the connection between the connector 11, the extensional connector 13, the external connector 2 and adaptor connector 221 more convenient and effective.

The switchable cable device of the present invention has at least the following advantages.

1. The cable 1 comprises at least two branches 12 on a side thereof. The cable 1 and the branches 12 each has the connector 11 at a distal end and the plurality of extensional connectors 13, and the miniature circuit boards 14, 23 and the chips 141, 231 are positioned in the connectors 11, the extensional connectors 13, the external connectors 2 and the adaptor connectors 221 for downloading programs automatically to fit various types of electronic devices and the external peripheral devices without any external housing or case.

2. The cable 1 and the branches 12 do not have large cases, and therefore easy to store and carry, and it can be promptly operated.

3. The connectors 11, the extensional connectors 13, the external connectors 2 and adaptor connectors 221 can suit various types of the electronic devices and the external peripheral devices to increase the applicability.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

The invention claimed is:

1. A switchable cable device, suitable for connecting between an electronic device and an external peripheral device for signal transmission, comprising:

a cable, comprising a connector on a side for electrically connecting to the electronic device; and at least two branches, disposed on other side thereof, each branch comprising a connector having at least one extensional connector, wherein said extensional connector and said connector comprise miniature circuit boards and chips which can independently renew an activation program according to an actual operation status or an operating system of a connected electronic device or an external peripheral device.

2. The switchable cable device according to claim 1, wherein said cable can be a coaxial cable and a power cord.

3. The switchable cable device according to claim 1, wherein said extensional connector can be a USB connector, a IEEE 1394 connector, a VGA connector, a RS232 connector, a RJ connector, a PS/2 connector, an audio/video signal connector and a power connector.

4. The switchable cable device according to claim 1, wherein said connector can be a USB connector, a IEEE 1394 connector, a VGA connector, a RS232 connector, a RJ connector, a PS/2 connector, an audio/video signal connector and a power connector.

5. The switchable cable device according to claim 1, wherein said chip can be a single chip, a microchip and a CPU.

6. The switchable cable device according to claim 1, wherein said extensional connectors can be electrically connected to an adaptor connector of an external connector in said external peripheral device.

* * * * *